United States Patent [19]

Jones

[11] 3,999,661

[45] Dec. 28, 1976

[54] SHIPPING CONTAINER

[75] Inventor: Charles E. Jones, Evanston, Ill.

[73] Assignee: Charles E. Jones & Associates, Evanston, Ill.

[22] Filed: Apr. 14, 1975

[21] Appl. No.: 567,514

[52] U.S. Cl. ..... 206/591; 229/2.5 R; 229/14 C; 150/.5

[51] Int. Cl.[2] ..... B65D 81/02; B65D 5/58; B65D 5/62

[58] Field of Search ..... 229/2.5, 29 M, 14 C; 150/.5; 206/521

[56] References Cited

UNITED STATES PATENTS

| | | | |
|---|---|---|---|
| 2,941,708 | 6/1960 | Crane et al. | 206/521 |
| 3,160,306 | 12/1964 | Smalley | 220/21 |
| 3,294,270 | 12/1966 | Geisler | 206/433 |
| 3,403,713 | 10/1968 | Good et al. | 220/9 R |
| 3,552,595 | 8/1975 | Gerner | 229/2.5 |
| 3,567,013 | 3/1971 | Tannenbaum | 229/2.5 |
| 3,618,287 | 11/1971 | Goghai | 206/524 |

*Primary Examiner*—William Price
*Assistant Examiner*—Douglas B. Farra
*Attorney, Agent, or Firm*—Guy A. Greenawalt

[57] ABSTRACT

A container which is especially adapted for packaging products for shipment and a method of vacuum forming the same, as an integral unit, from sheet or web stock of a continuous plastic material so as to provide integrally connected wall sections which are adapted to hinge to product enclosing position and to support the product or a group of products in an inner portion of the double walled container, the contour of the inner walls being drawn, if desired, to conform to the contour of the product or products to be enclosed and there being spaced rib formations interposed between the walls of the inner container and the outer container which are drawn integrally with the inner or outer wall members and which serve to support the product containing portion of the inner container in spaced relation within the outer container.

5 Claims, 8 Drawing Figures

FIG. 2
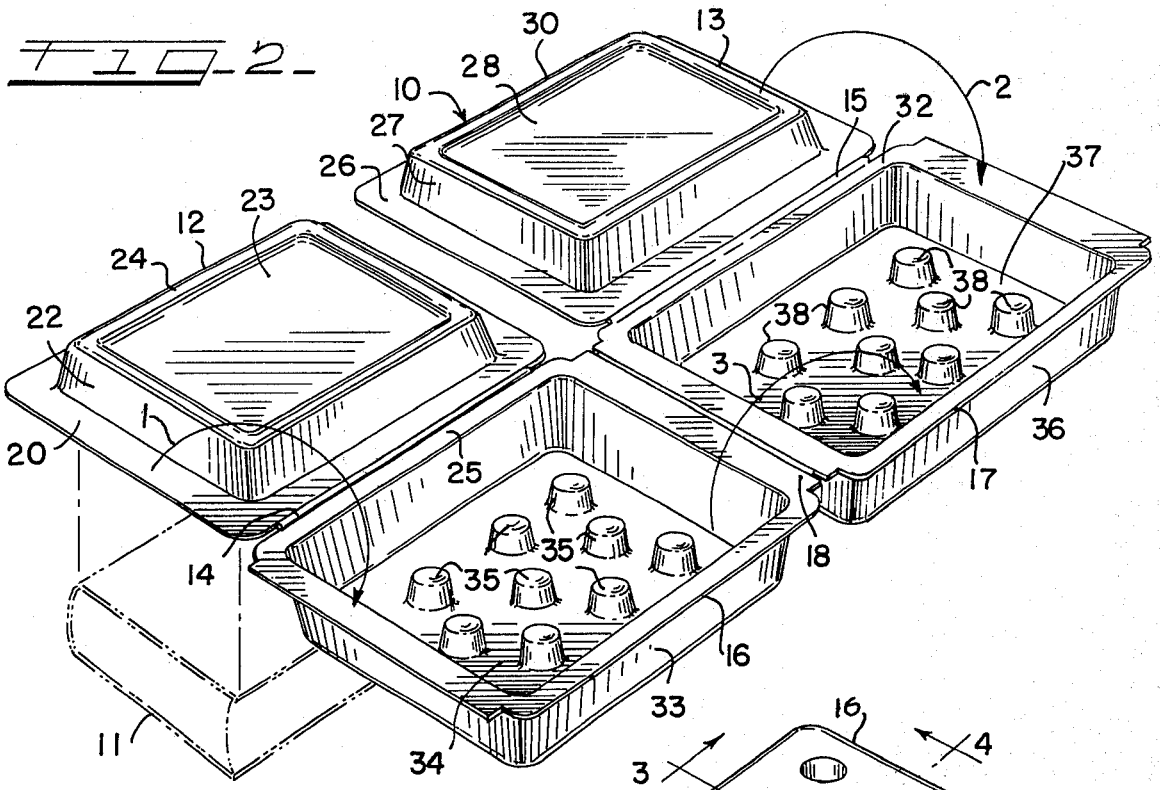
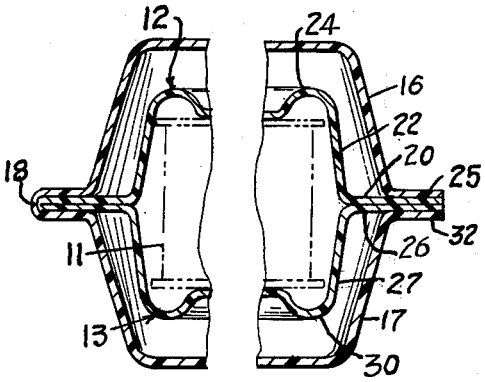
FIG. 4
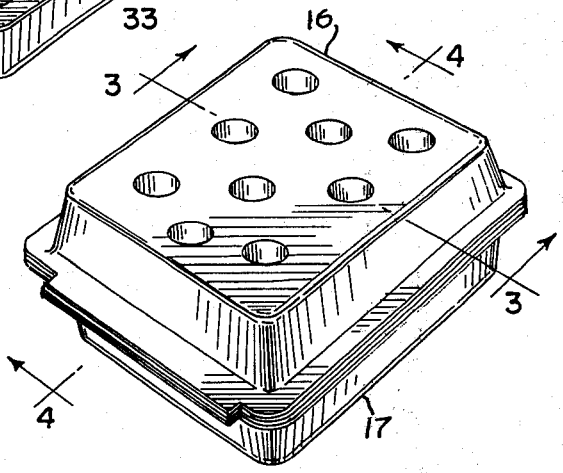
FIG. 1
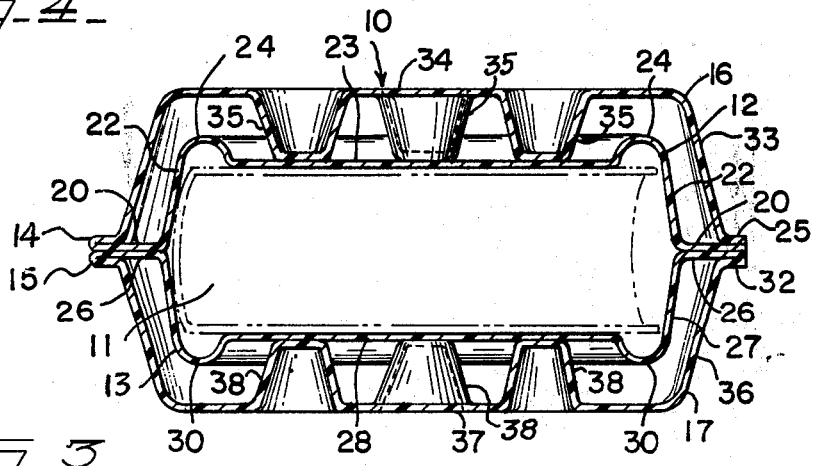
FIG. 3

1
2
3
40
42
43
44
45
46
47
48
50
52
53
54
55
56
57
60
61
62
63
70
72
73
74
75
76
77
78
80
82
83
84
85
86
87
88
90
92
93
94
95
8

SHIPPING CONTAINER

This invention relates to the forming of packaging containers of continuous plastic materials and is more particularly concerned with the forming of an improved double wall packaging container unit which is especially adapted for packaging a variety of products including those which are of a fragile or somewhat fragile nature and which may require protection when packed for shipment so as to minimize the likelihood of damage when handled in a careless manner.

In packaging products for shipment, it is frequently necessary, or highly desirable, to make special provision for protecting the product from damage which could otherwise result from dropping the package or subjecting it to numerous hazardous handling conditions which may be encountered during shipment. Generally, it has been the practice to enclose the product or products in an oversize shipping container with some type of packing material surrounding it, such as, shredded paper, excelsior or any one of a number of other materials especially designed for this purpose or suitable for use in this manner. Another procedure frequently employed has been to enclose the product or products in an inner carton or bag and place the bag or carton in an outer protective carton either with or without the addition of packing material between the two containers. More recently inner container forming structures of foam plastic or the like have been developed for protective packaging operations which serve to enclose, or partially enclose, the product or products, and which have substantial thickness so as to fill a certain amount of space provided between the outer container walls and the product surfaces. All of these procedures are relatively costly in terms of time and labor required for assembly as well as the nature and quantity of the materials required.

A general object of the present invention is to provide a packaging system and materials therefor which enables a product to be enclosed or encased in a double wall shipping container assembly so as to afford protection against damage to the product with minimum use of material and labor.

A more specific object of the invention is to provide a container structure and a method of forming the same from a continuous plastic sheet or web material so as to provide in a single unit an inner and outer container with provision for suspending or supporting the inner container, in which the product is placed, within the outer container and interposing between spaced walls of the two container structures supporting and spacing elements which are an integral part of either the outer or inner container wall structures.

Another object of the invention is to provide a container assembly of the type described which is capable of use as a double wall packaging unit and which may be vacuum formed from suitable plastic sheet or web material with minimum waste of the material.

Still another object of the invention is to provide a double wall single unit plastic shipping container in which the inner wall structures are hinged to associated outer wall structures and are of a size to fold within the outer wall structures so as to enclose a product or products in the inner container and provide space between the product or products and the outer container walls which will serve to cushion the product or products and minimize the likelihood of damage to the product or products when the outer container walls are damaged as a result of careless handling or the like.

A further object of the invention is to provide a method of forming a double wall container assembly for packaging a product or products for shipment, or the like, wherein a sheet or web of continuous plastic film material, having substantial stiffness and capable of hinging when reduced to a relatively thin cross section, is vacuum formed to provide inner container sections of a size and configuration to enclose the product or products to be packaged and outer container sections to which the inner sections are integrally connected by hinge formations, the outer container sections being connected to each other by hinge formations and being of larger size than the inner container sections so as to close over the inner container sections when the latter are hinged to a product enclosing position, and the inner and outer container sections having walls which, when the container sections are closed, are disposed opposite each other and separated by spaced rib formations, or the like, the latter being formed in one or the other of the oppositely disposed walls so as to space the product or products an appreciable distance from the plane of the walls of the outer container and thereby minimize the liability of damage to the product in the event of damage to the walls of the outer container sections as a result of careless handling or the like.

These and other objects and advantages of the invention will be apparent from a consideration of the method of forming the containers which is herein described and the several forms of the containers which are shown by way of illustration in the accompanying drawings wherein:

FIG. 1 is a perspective view of a packaging container assembly which embodies the principal features of the invention, the container being shown in fully closed position;

FIG. 2 is a perspective view of the container of FIG. 1 in fully open condition in which it is formed and which is adapted to package a book, or other product of similar size and configuration, the latter being shown in phantom line;

FIG. 3 is a cross sectional view, taken on the line 3—3 of FIG. 1, to an enlarged scale;

FIG. 4 is a fragmentary cross sectional view taken on the line 4—4 of FIG. 1, to an enlarged scale;

Figures 5, 6, 7, 8:
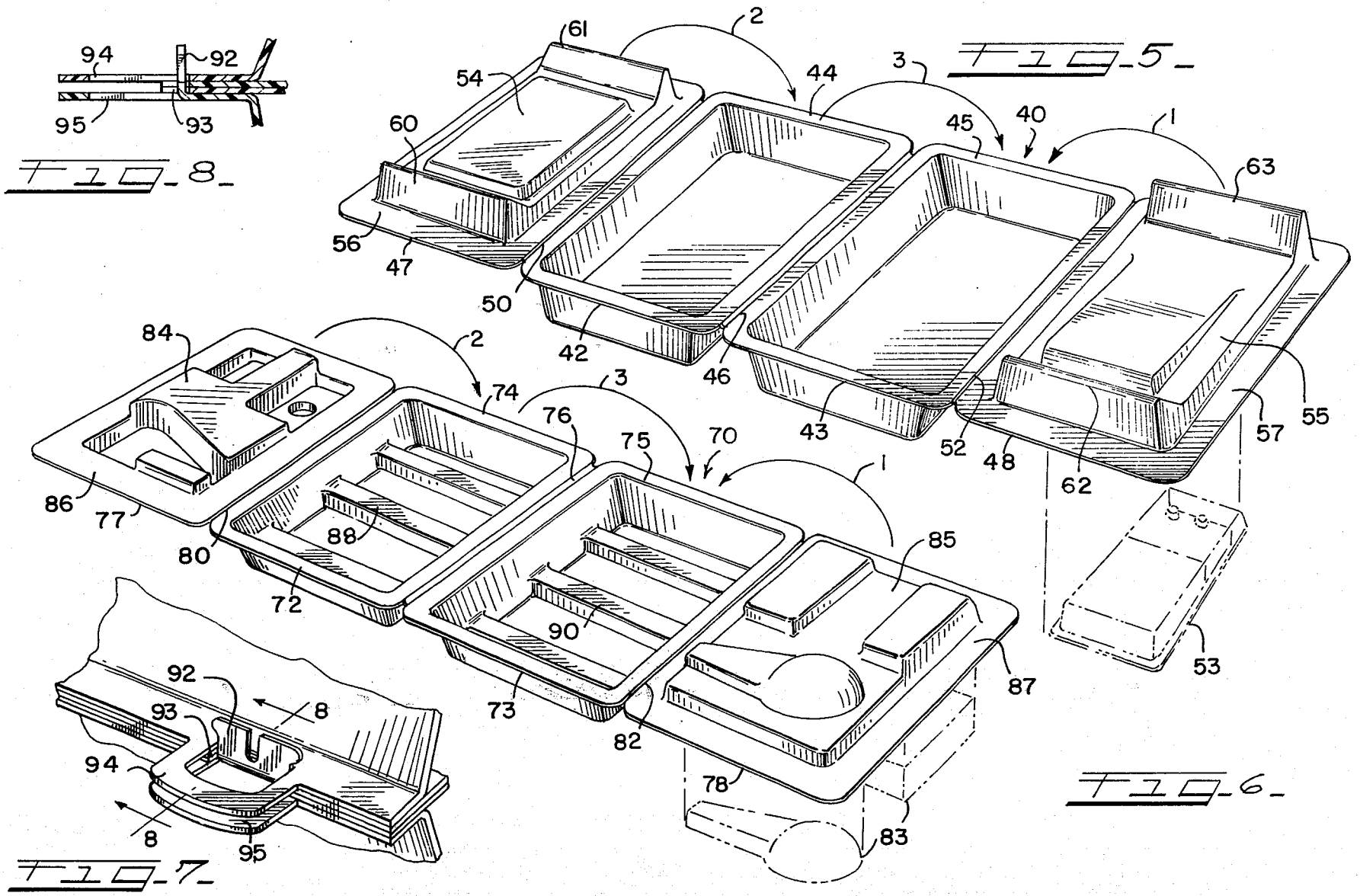
FIG. 5 is a perspective view of another form of the container assembly.
FIG. 6 is a perspective view of a further form of the container assembly.
FIG. 7 is a fragmentary perspective view showing a locking or latching arrangement and a handle structure which may be incorporated in the illustrated container assemblies.
FIG. 8 is a fragmentary cross sectional view taken on the line 8—8 of FIG. 7.

Referring first to FIGS. 1 to 4, there is illustrated a container structure or assembly 10 which is especially adapted for packaging a product, such as, for example, a book which is indicated in phantom line at 11 in FIGS. 2 and 3. The container assembly 10 comprises two inner container forming sections or members 12 and 13 which are separated from each other and integrally connected by hinge formations or hinge sections 14 and 15 to two outer container forming sections or members 16 and 17, the latter being in turn integrally connected to each other by a hinge formation or hinge section 18, so that the four container sections 12, 13, 16 and 17 and the associated hinge connections form a single, integral unit with the inner container sections 12 and 13 being adapted to fold onto the outer container sections 16 and 17, respectively, and the latter being thereafter foldable upon each other so as to enclose the inner container sections and form a double wall container assembly.

The two container forming members 12 and 13 which co-operate to form the inner container structure are drawn to a shape which is determined by the configuration of the article or product 11 which is to be packaged so as to snugly encompass the same. To this end the section 12, in the open position shown in FIG. 2, comprises a peripheral flange formation 20 and a pocket forming central portion for receiving the article 11 which is defined by upstanding peripheral side wall formation 22 and a top wall panel 23 with a peripheral, outwardly or upwardly projecting rib formation 24 at the juncture of the panel 23 and the side wall 22. The flange 20 is connected along one side or edge of a peripheral flange formation 25 on the associated outer container member or section 16. In a similar manner the inner container section 13 comprises a peripheral flange formation 26 and a pocket forming central portion for accommodating the article 11 which is defined by upstanding peripheral side wall formation 27 and a top wall panel 28 with a peripheral, upwardly projecting rib formation 30 at the juncture of the panel 28 and the side wall 27. The flange 26 is connected along one side or edge by the integral hinge formation 15 with a peripheral flange formation 32 on the associated outer container forming section 17. The combined depth of the pockets formed in the two inner container sections 12 and 13 is determined by the thickness dimension of the article 11 while the width and length are determined by the corresponding dimensions of the article 11.

The container forming sections or members 16 and 17 which co-operate to form the outer container are drawn or shaped in an identical manner to accommodate the inner container members. In the position shown in FIG. 2 the outer container section 16 has a side wall formation 33 depending from the flange 25 and extending to a bottom wall panel formation 34 in which there are formed a plurality of upstanding post members 35 which serve as spaced supports for the inner container panel member 23 and also as spacers for holding the panels 23 and 34 in spaced relation. The outer container member 17 is formed to provide side wall formation 36 depending from the peripheral flange 32 and extending to a bottom panel formation 37 in which there are formed a plurality of spaced post members 38 serving as supports and spacers for the panel 28 of the inner container member 13. The outer container members 16 and 17 have a width and length dimensioned relative to the inner container members 12 and 13 so as to support the latter with the wall formations 22 and 27 spaced from the opposed wall formations 33 and 36 when the containers are closed and the flanges 20 and 26 are clamped between flanges 25 and 32. The inner container wall panels 23 and 28 may be provided with circular bead formations (not shown) forming pockets for the post members 35 to nest in and/or the ends of the post members may be adhered to the panels 23 and 28 by spot gluing or heat sealing to increase the rigidity of the container.

The container members are closed upon the article 11 by folding or hinging the members in the sequence indicated by the curved arrows 1, 2 and 3 in FIG. 2 with the article being placed in one or the other of the inner container members 12 or 13 at any point before the final closing or hinging of the outer container sections 16 and 17.

The container assembly 10 may be conveniently formed with maximum economy of material in a continuous vacuum forming operation from a sheet or web of plastic material, preferably, high density polyethylene or polypropolene. Other plastic materials having the ability to form a hinge when blanking out could be used but are generally more costly or otherwise not as satisfactory for this purpose. The container lends itself to high production operations since extruding the film, vacuum forming or drawing of the container elements, filling with the product or products and closing, can be carried out in a continuous production line operation.

Another form of the container assembly is illustrated in the open position, at 40 in FIG. 5, which is adapted to be formed from a sheet or web of lesser or greater width than the sheet or web stock employed for the assembly of FIGS. 1 to 4 and which may be used in a continuous production line operation. In this form the two outer container sections or members 42 and 43 are in the form of rectangular trays with outwardly directed flanges 44 and 45 which are connected to each other along two adjacent longer side edges by an integral hinge formation 46 while the inner container sections or members 47 and 48 are connected to the opposite edges of the flanges 44 and 45 by hinge formations or sections 50 and 52. The inner container sections or members 47 and 48 are formed or drawn to accommodate an article, for example, a radio, as indicated at 53 in phantom line, or any other product of a generally rectangular configuration. The center portion of each of the members 47 and 48 is drawn to conform to or to accommodate the shape of the article 53, defining a pocket of the size and shape required to enclose the article, the pockets opening downwardly in the open position which is shown in FIG. 5. The pocket forming center portions 54 and 55 of the inner container sections have surrounding peripheral flange formations 56 and 57, respectively, which are connected along one side edge by hinge sections 50 and 52 to the flanges 44 and 45 of the associated outer container sections 42 and 43. In addition to forming pockets for the article 53 the sections 54 and 55 each have formed at opposite ends upstanding cross ribs 60, 61 and 62, 63 which are dimensioned so as to seat on the bottom of the associated outer container section 42 and 43 when the sections 47 and 48 are swung about the hinge formations 50 and 52 into the outer container sections 42 and 43. The cross ribs 60, 61 and 62, 63 serve as spacers and supports for holding the inner container sections 47 and 48, when closed, with the article engaging walls spaced from the outer container walls so as to cushion or resiliently support the inner container within the outer container.

In using the container assembly 40 for packaging the article 53 the sequence of folding operations is indicated by the arrows 1, 2 and 3 in FIG. 5 with the article 53 being positioned within the inner container members 47 and 48 at any convenient point prior to their closing.

The container arrangement shown in FIG. 5 lends itself to continuous vacuum forming, with minimum waste, from stock material which may be in the form of an elongate sheet or web, having a transverse dimension sufficient to form successive container units disposed crosswise therein. Alternatively, the units may be formed from stock material of narrower width dimension by lengthwise positioning of the units in the material. Providing the spacing and inner container supporting elements on the inner container members permits the outer container members to be drawn with smooth or clear outer wall surfaces which may accommodate advertising, a trademark or other printed or embossed material.

Another form of the container assembly is illustrated at 70 in FIG. 6. This form of the assembly may be vacuum formed from stock material in the same manner as the container assembly 40 since the basic arrangement of the container sections is the same. The container assembly 70 comprises a pair of outer container members or sections 72 and 73 in the form of rectangular trays having peripheral flanges 74 and 75 which are hingedly connected along adjacent edges by a hinge section 76 and which have the oppositely disposed flange edges hingedly connected to inner container forming members 77 and 78 by hinge formations 80 and 82. The inner container sections or members 77 and 78 have the center portions drawn or shaped to conform to the shape of the individual articles to be packaged, which are indicated in phantom line at 83 in FIG. 6 and which may be, for example, a small camera and accessories of the type frequently marketed as a kit. The pocket forming article accommodating center portions 84 and 85 of the container sections 77 and 78 are surrounded by flange formations 86 and 87 which are connected to the flanges 74 and 75 by integral hinge sections 80 and 82 so as to enable the sections 77 and 78 to be folded over onto the outer container sections 72 and 73. The outer container sections 72 and 73 are formed with a plurality of integral, inwardly extending, spaced cross rib formations 88 and 90 which are spaced to support the inner container sections 77 and 78 in spaced relation relative to the walls of the outer container sections 72 and 73 when the assembly is closed. The folding sequence for the container sections is the same as for the container assembly 40 and is indicated by the arrows 1, 2 and 3.

In all forms of the container assembly shown a means may be provided for sealing or locking the container forming members in the closed position. Since the peripheral flanges on the inner and outer container members overlie each other they may be secured by an adhesive, heat sealed, stapled or otherwise secured. One form of locking or latching means found to be suitable is illustrated in FIGS. 7 and 8 together with a handle forming means which may also be provided, if found desirable. As shown in FIGS. 7 and 8 the latching is accomplished by providing a bendable locking or latching tab 92 on the flange of one of the outer container members and co-operating locking or latching slots 93 in the other three flanges into which the latching tab 92 may be swung with the tab 92 and slots 93 being dimensioned so that the tab 92 will be positioned with its opposite side edges frictionally engaging opposed edges defining the slots 93 so as to be frictionally retained in latching relation in the slots 93. A handle may be provided for the container assembly by providing U-shaped extension members 94 and 95 on the outer container flanges which, in the closed position of the members, will align and form a double thickness handle. Several of the latch arrangements may, of course, be provided at different positions on the overlapped flange formations on a non-hinged edge. The handle arrangement may be employed independently of any latching arrangement on any flange portion which is not hinged.

While the several forms of the container assemblies shown have been described as fabricated from sheet or web stock by vacuum forming methods, it will be understood that injection molding may be employed. However, vacuum forming affords greater economy and more flexibility while producing a highly satisfactory product.

I claim:

1. A container assembly adapted for enclosing an article or a group of articles which is fabricated as a single unit from a continuous plastic material, said container comprising outer container members in the form of relatively thin walled trays of substantial depth and having side wall members terminating at edge flange formations which are in planes generally normal to the planes of the associated side wall members, said outer container members having straight side wall portions which are integrally connected to each other by a hinge formation extending along said straight side wall portions so that when said container members are swung about said hinge formation to a closed position said flange formations overlie each other and inner container members in the form of relatively thin walled trays of smaller dimensions than the outer container members, said inner container members having side wall members terminating at flange formations which are in planes generally normal to the planes of the associated side wall members, said inner container members having straight side wall portions which are integrally connected to straight side wall portions of said outer container members by hinge formations which are in spaced relation to the hinge formation connecting said outer container members to each other, said inner container members being of a size and configuration to fit within said outer container members, when said inner container members are swung on said hinge formations into outer container members and said outer container members are swung to a closed position, and to position the confronting wall members in spaced relation to each other so as to provide substantial air space between said confronting wall members, said inner container members being positioned with the flange formations in overlying relation and cooperating to form an inner enclosure for said article or articles when said container members are in closed position, said inner container members having their wall members configured for confining said article or articles in pocket forming areas between said inner container members, and spacer forming members disposed in spaced relation in the air space areas between said confronting wall members so as to hold said confronting wall members in spaced relation to each other, which spacer forming members are integrally formed in portions of said confronting wall members and extend between said confronting wall members.

2. A container assembly as set forth in claim 1 wherein certain of said edge flange formations have outwardly extending portions constituting extensions which are shaped so that when the container members are closed said extensions overly each other and form handle members.

3. A container assembly as set forth in claim 1 wherein an outwardly extending flange formation on one of said outer container members is cut to provide a latching tab and an associated flange formation on a cooperating outer container member is notched for receiving in frictional engagement said latching tab.

4. A container assembly as set forth in claim 1 wherein said outer container members are integrally connected by a hinge formation extending along adjoining sides of said outer container members and said inner container members are integrally connected to said outer container members by hinge formations extending along sides of said outer container members which are disposed opposite said adjoining sides of said outer container members.

5. A container assembly as set forth in claim 1 wherein said inner container members are integrally connected by a hinge formation extending along sides of said outer container members which are disposed opposite each other and said inner container members are integrally connected to said outer container members by hinge formations extending along sides of said outer container members which adjoin the hinge formation connecting said outer container members.

* * * * *